US010787889B2

(12) United States Patent
Salihbegovic et al.

(10) Patent No.: US 10,787,889 B2
(45) Date of Patent: Sep. 29, 2020

(54) GAS LIFT VALVE HAVING SHEAR OPEN MECHANISM FOR PRESSURE TESTING

(71) Applicant: Weatherford Technology Holdings, LLC, Houston, TX (US)

(72) Inventors: Zlatko Salihbegovic, New Iberia, LA (US); Stephen D. Long, Houston, TX (US); Lance W. Racca, Rayne, LA (US); Brian M. Sternaman, Lafayette, LA (US)

(73) Assignee: Weatherford Technology Holdings, LLC, Houston, TX (US)

( * ) Notice: Subject to any disclaimer, the term of this patent is extended or adjusted under 35 U.S.C. 154(b) by 207 days.

(21) Appl. No.: 16/046,758

(22) Filed: Jul. 26, 2018

(65) Prior Publication Data

US 2020/0032627 A1 Jan. 30, 2020

(51) Int. Cl.

| | |
|---|---|
| ***E21B 43/12*** | (2006.01) |
| ***E21B 34/06*** | (2006.01) |
| ***E21B 34/08*** | (2006.01) |
| ***E21B 34/14*** | (2006.01) |
| ***E21B 47/10*** | (2012.01) |
| *E21B 34/00* | (2006.01) |

(52) U.S. Cl.

CPC ..... *E21B 43/123* (2013.01); *E21B 34/063* (2013.01); *E21B 34/08* (2013.01); *E21B 34/14* (2013.01); *E21B 47/1025* (2013.01); *E21B 2034/007* (2013.01)

(58) Field of Classification Search

CPC ..... E21B 43/123; E21B 34/063; E21B 34/08; E21B 47/1205; E21B 2034/007

See application file for complete search history.

(56) References Cited

U.S. PATENT DOCUMENTS

| | | | | |
|---|---|---|---|---|
| 2,994,335 A * | 8/1961 | Dudley | ..... | E21B 43/123 137/155 |
| 4,359,094 A | 11/1982 | Risinger | | |
| 4,901,798 A * | 2/1990 | Amani | ..... | E21B 34/10 166/311 |
| 5,979,553 A | 11/1999 | Brink | | |

(Continued)

OTHER PUBLICATIONS

Petroleum Technology Company; "ShearLift-T(TM);" Brochure, obtained from http://www.ptc.as/ on Jul. 6, 2018; 2-pgs.

(Continued)

*Primary Examiner* — Yong-Suk Ro

(74) *Attorney, Agent, or Firm* — Blank Rome LLP

(57) ABSTRACT

For gas lift, gas lift valves install on a completion in a wellbore. The gas lift valve has a pressure-sensitive valve and a check valve configured to control communication in the valve. A piston is held closed with a first connection relative to the valve's outlet exposed to tubing pressure, while the check valve is held open in the valve with a second connection. Pressure testing can be performed on the integrity of the tubing and casing by increasing the tubing and annulus pressures while the piston stays closed. The gas lift valve is then actuated for operation by increasing the tubing or annulus pressure beyond a predetermined limit of the first connection to release the piston to move open relative to the outlet. The movement of the piston releases the hold of the second connection on the check valve so the check valve can function normally as a one-way valve.

20 Claims, 6 Drawing Sheets

(56) References Cited

U.S. PATENT DOCUMENTS

| | | | | |
|---|---|---|---|---|
| 6,932,581 | B2 * | 8/2005 | Messick | E21B 43/123 417/54 |
| 7,647,975 | B2 * | 1/2010 | Messick | E21B 43/123 166/372 |
| 7,784,553 | B2 | 8/2010 | Moreno | |
| 8,291,981 | B2 | 10/2012 | Tveiten et al. | |
| 9,010,353 | B2 | 4/2015 | Salihbegovic | |
| 9,580,991 | B2 | 2/2017 | Harestad et al. | |
| 2006/0137881 | A1 * | 6/2006 | Schmidt | E21B 43/122 166/372 |
| 2011/0127043 | A1 * | 6/2011 | Hahn | E21B 43/123 166/373 |
| 2011/0203805 | A1 | 8/2011 | Kritzler et al. | |
| 2012/0211239 | A1 | 8/2012 | Kritzler et al. | |
| 2013/0220599 | A1 | 8/2013 | Rae | |
| 2013/0312833 | A1 * | 11/2013 | Salihbegovic | E21B 43/123 137/1 |
| 2014/0076579 | A1 * | 3/2014 | Salihbegovic | E21B 34/14 166/374 |
| 2015/0083433 | A1 | 3/2015 | Long et al. | |
| 2016/0053579 | A1 | 2/2016 | Salihbegovic | |
| 2016/0145983 | A1 | 5/2016 | Salihbegovic et al. | |
| 2017/0152733 | A1 | 6/2017 | Salihbegovic | |
| 2018/0142532 | A1 | 5/2018 | Salihbegovic et al. | |
| 2018/0142533 | A1 | 5/2018 | Joerpeland et al. | |

OTHER PUBLICATIONS

Petroleum Technology Company; "Cost and Time Savings possible when using Shear-able Gas Lift Orifice and IPO Unloading Valves;" copyright 2016, 1-pg.

Brodie, A of Petroleum Technology Company; "A revolutionary IPO unloading gas lift valve;" 35th Gas-Lift Workshop Houston, Texas, USA Feb. 6-10, 2012, 20-pgs.

Weatherford; "RDDK-2A Shearable Orifice Gas-Lift Valve"; Brochure, copyright 2013-2016; 2-pgs.

Petroleum Technology Company; "ShearLift-A(TM);" Brochure, obtained from http://www.ptc.as/ on Jul. 6, 2018; 2-pgs.

Int'l Search Report & Written Opinion received in copending PCT Application No. PCT/US2019/040180 dated Oct. 16, 2019, 15 pages.

* cited by examiner

GAS LIFT VALVE HAVING SHEAR OPEN MECHANISM FOR PRESSURE TESTING

BACKGROUND OF THE DISCLOSURE

To obtain hydrocarbon fluids from an earth formation, a wellbore is drilled into an area of interest within a formation. The wellbore may then be "completed" by inserting casing in the wellbore and setting the casing using cement. Alternatively, the wellbore may remain uncased as an "open hole"), or it may be only partially cased. Regardless of the form of the wellbore, production tubing is run into the wellbore to convey production fluid (e.g., hydrocarbon fluid, which may also include water) to the surface.

Often, pressure within the wellbore is insufficient to cause the production fluid to naturally rise through the production tubing to the surface. In these cases, an artificial lift system can be used to carry the production fluid to the surface. One type of artificial lift system is a gas lift system, of which there are two primary types of systems: tubing-retrievable gas lift systems and wireline-retrievable gas lift systems. Each type of gas lift system uses several gas lift valves spaced along the production tubing. The gas lift valves allow gas to flow from the annulus into the production tubing so the gas can lift production fluid in the production tubing. Yet, the gas lift valves prevent fluid to flow in the opposite direction from the production tubing into the annulus.

A typical wireline-retrievable gas lift system 10 is shown in FIG. 1. Operators inject compressed gas G into the annulus 22 between a production tubing string 20 and the casing 24 within a cased wellbore 26. A valve system 12 supplies the injection gas G from the surface and allows produced fluid to exit the gas lift system 10.

Side pocket mandrels 30 spaced along the production string 20 hold gas lift valves 40 within side pockets 32. As noted previously, the gas lift valves 40 are one-way valves that allow gas flow from the annulus 22 into the production string 20 and prevent reverse flow from the production string 20 into the annulus 22.

A production packer 14 located on the production string 20 forces the flow of production fluid P from a formation up through the production string 20 instead of up through the annulus 22. Additionally, the production packer 14 forces the gas flow from the annulus 22 into the production string 20 through the gas lift valves 40.

In operation, the production fluid P flows from the formation into the wellbore 26 through casing perforations 28 and then flows into the production tubing string 20. When it is desired to lift the production fluid P, compressed gas G is introduced into the annulus 22, and the gas G enters from the annulus 22 through ports 34 in the mandrel's side pockets 32. Disposed inside the side pockets 32, the gas lift valves 40 control the flow of injected gas I into the production string 20. As the injected gas I rises to the surface, it helps to lift the production fluid P up the production string 20 to the surface.

Gas lift valves 40 have been used for many years to assist production of fluid to the surface. The valve 40 uses pressure-sensitive valve mechanism having a metal bellows and a piston to convert pressure into movement. Injected gas acts on the bellows to open the pressure-sensitive valve mechanism, and the gas passes through the valve 40 into the tubing string. As differential pressure is reduced on the bellows, the valve mechanism in the valve 40 can close.

Depending on the completion, other types of downhole devices may be installed in the side pocket mandrels 30. For example, "dummy" valves can be installed in the side pockets 32 of the mandrels 30 to allow for certain pressure tests to be performed. These dummy valves are not actually valves because they merely position in the mandrels 30 to seal of the mandrel's ports 34, acting as isolation devices.

With the dummy valves installed, for example, the integrity of the tubing and the casing of the completion can be tested at high pressures. After testing, the dummy valves are removed and replaced by live gas lift valves 40. Typically, wireline intervention is used to remove the dummy valves from the mandrels 30 and to then install the live gas lift valves 40 in the mandrels 30. The wireline intervention can be very time consuming, technically challenging, and expensive particularly in offshore applications.

The subject matter of the present disclosure is directed to overcoming, or at least reducing the effects of, one or more of the problems set forth above.

SUMMARY OF THE DISCLOSURE

According to the present disclosure, an apparatus is used for a gas lift valve on tubing in a wellbore. The gas lift valve has a pressure-sensitive valve and a check valve. The pressure-sensitive valve is configured to control communication from an inlet toward an outlet. The inlet can be exposed to one of an annulus pressure and a tubing pressure of the wellbore, and the outlet can be exposed to the other of the annulus pressure and the tubing pressure.

For example, the gas lift valve can be configured for a tubing flow application. As such, the inlet would be exposed to the annulus pressure, and the outlet would be exposed to the tubing pressure of the tubing. For its part, the check valve is configured to prevent communication from the outlet toward the inlet. Alternatively, the gas lift valve can be configured for an annulus flow application. As such, the inlet would be exposed to the tubing pressure, and the outlet would be exposed to the annulus pressure.

The apparatus comprises a piston, a first connection, and a second connection. The piston is disposed between the check valve and the outlet and is exposed to a pressure differential between the annulus pressure and the tubing pressure. The piston is movable from a closed condition to an opened condition relative to the outlet.

The first connection holds the piston in the closed condition and is configured to release hold of the piston in response to a predetermined level of the pressure differential. The second connection connects the piston to the check valve. The second connection with the piston in the first position holds the check valve open, whereas the second connection with the piston in the second position releases the hold of the check valve to close.

In one configuration, the piston comprises a piston body and a sleeve body. The piston body is sealed in the valve and is exposed to the pressure differential between the annulus pressure in the valve and the tubing pressure via a tubing port of the valve. The sleeve body is sealed in the valve and is movable from the closed condition to the opened condition relative to the outlet port. The first connection connects the piston body to the sleeve body, and the second connection connects the sleeve body to the check valve.

The first connection can include a rod having a first end coupled to the piston body and having a second end coupled to the sleeve body. The rod can be breakable in response to a predetermined load between the first and second ends caused by the annulus pressure greater than the tubing pressure. The second connection can include a wire having a first end affixed to the check valve and a second end affixed to the sleeve body. The sleeve body in the closed condition holds the check valve open with tension of the wire, whereas the sleeve body in the opened condition releases the tension of the wire on the check valve to close.

In another configuration, the piston comprises a sleeve body sealed in the valve and exposed to the pressure differential. The sleeve body is movable from the closed condition to the opened condition relative to the outlet. The first connection connects the sleeve body to a fixed portion of the valve, and the second connection connects the sleeve body to the check valve.

Again, the first connection can include a rod having a first end coupled to the sleeve body and having a second end coupled to the fixed portion of the valve. The rod can be breakable in response to a predetermined load between the first and second ends caused by the tubing pressure greater than the annulus pressure. Also, the second connection can include a wire having a first end affixed to the check valve and a second end affixed to the sleeve body. The sleeve body in the closed condition holds the check valve open with tension of the wire, whereas the sleeve body in the opened condition releases the tension of the wire on the check valve to close.

In a number of variations, the check valve can include a dart body biased with a biasing element toward a seat in the valve. The piston can include a lock locking the piston in the opened condition once moved. For example, the lock can include a collet disposed on the piston engageable with a shoulder defined in the valve.

In additional variations, the piston can include seals sealing off the outlet with the piston in the closed condition. The piston can include an aperture communicating an interior of the piston outside the piston, the aperture being misaligned from the outlet with the piston in the closed condition and being aligned with the outlet with the piston in the opened condition. The piston can include a biasing element biasing the piston from the closed condition toward the opened condition.

The apparatus can further comprise a housing having the piston, the first connection, and the second connection. The housing can be integral to the gas lift valve or can be separately affixable to the gas lift valve.

According to the present disclosure, an apparatus is used on tubing in a wellbore. The apparatus comprises a gas lift valve disposed on the tubing and having an inlet and an outlet. The inlet can be exposed to one of an annulus pressure and a tubing pressure of the wellbore, and the outlet can be exposed to the other of the annulus pressure and the tubing pressure. For example, the gas lift valve can be configured for a tubing flow application. As such, the inlet would be exposed to the annulus pressure, and the outlet would be exposed to the tubing pressure of the tubing.

A pressure-sensitive valve disposed in the gas lift valve is configured to control communication from the inlet toward the outlet, and a check valve disposed in the gas lift valve is configured to prevent communication from the outlet toward the inlet.

A piston is disposed in the gas lift valve between the check valve and the outlet and is exposed to a pressure differential between the annulus pressure and the tubing pressure. The piston is movable from a closed condition to an opened condition relative to the outlet port.

The first connection holds the piston in the closed condition and is configured to release hold of the piston in response to a first predetermined level of the pressure differential. The second connection connects the piston to the check valve. The second connection with the piston in the first position holds the check valve open, whereas the second connection with the piston in the second position releases the hold of the check valve to close.

The piston, the first connection, and the second connection can have any of the previously described features. Again, the first connection can be configured to release the hold of the piston in response to the first predetermined level of the annulus pressure greater than the tubing pressure, or the first connection can be configured to release the hold of the piston in response to the first predetermined level of the tubing pressure greater than the annulus pressure.

The apparatus can further include a plurality of the gas lift valve disposed on the tubing. In fact, the apparatus can even further include a shearable orifice disposed on the tubing downhole of the gas lift valves. The shearable orifice is configured to open in response to a second predetermined level greater than the first predetermined level.

The present disclosure discloses a method for gas lift in a completion string disposed in a wellbore. A gas lift valve having an inlet and an outlet is configured by holding a piston in the gas lift valve with a first hold in a first closed condition relative to the outlet and holding a check valve in the gas lift valve with a second hold in a second opened condition between the inlet and the outlet. The gas lift valve is installed on the completion string disposed in the wellbore. The inlet can be exposed to one of an annulus pressure and a tubing pressure of the wellbore, and the outlet can be exposed to the other of the annulus pressure and the tubing pressure. For example, the gas lift valve can be configured for a tubing flow application. As such, the inlet would be exposed to the annulus pressure, and the outlet would be exposed to the tubing pressure of the tubing.

The method comprises testing pressure integrity of the completion by alternatingly increasing a pressure differential (i) between the tubing pressure relative to the annulus pressure and (ii) between the annulus pressure relative to the tubing pressure. The gas lift valve are actuated for operation after testing the pressure integrity by: releasing the first hold on the piston to move from the first closed condition toward a first opened condition relative to the outlet by increasing the pressure differential beyond a predetermined limit of the first hold; and releasing, in response to the movement of the piston, the second hold of the check valve to move from the second opened condition toward a second closed position between the inlet and outlet.

Installing the gas lift valve on the completion string disposed in the wellbore can comprise deploying the gas lift valve with wireline, or deploying the gas lift valve on tubing.

Testing the pressure integrity of the completion can comprise first increasing the tubing pressure relative to the annulus pressure followed by increasing the annulus pressure relative to the tubing pressure. Accordingly, actuating the gas lift valve can comprise releasing a temporary connection to the piston by increasing the pressure differential of the annulus pressure relative to the tubing pressure beyond the predetermined limit for releasing the temporary connection.

Testing the pressure integrity of the completion can comprise first increasing the annulus pressure relative to the tubing pressure followed by increasing the tubing pressure relative to the annulus pressure. Accordingly, actuating the gas lift valve can comprise releasing a temporary connection to the piston by increasing the pressure differential of the tubing pressure relative to the annulus pressure beyond the predetermined limit for releasing the temporary connection.

The foregoing summary is not intended to summarize each potential embodiment or every aspect of the present disclosure.

DETAILED DESCRIPTION OF THE DISCLOSURE

Figure 1:
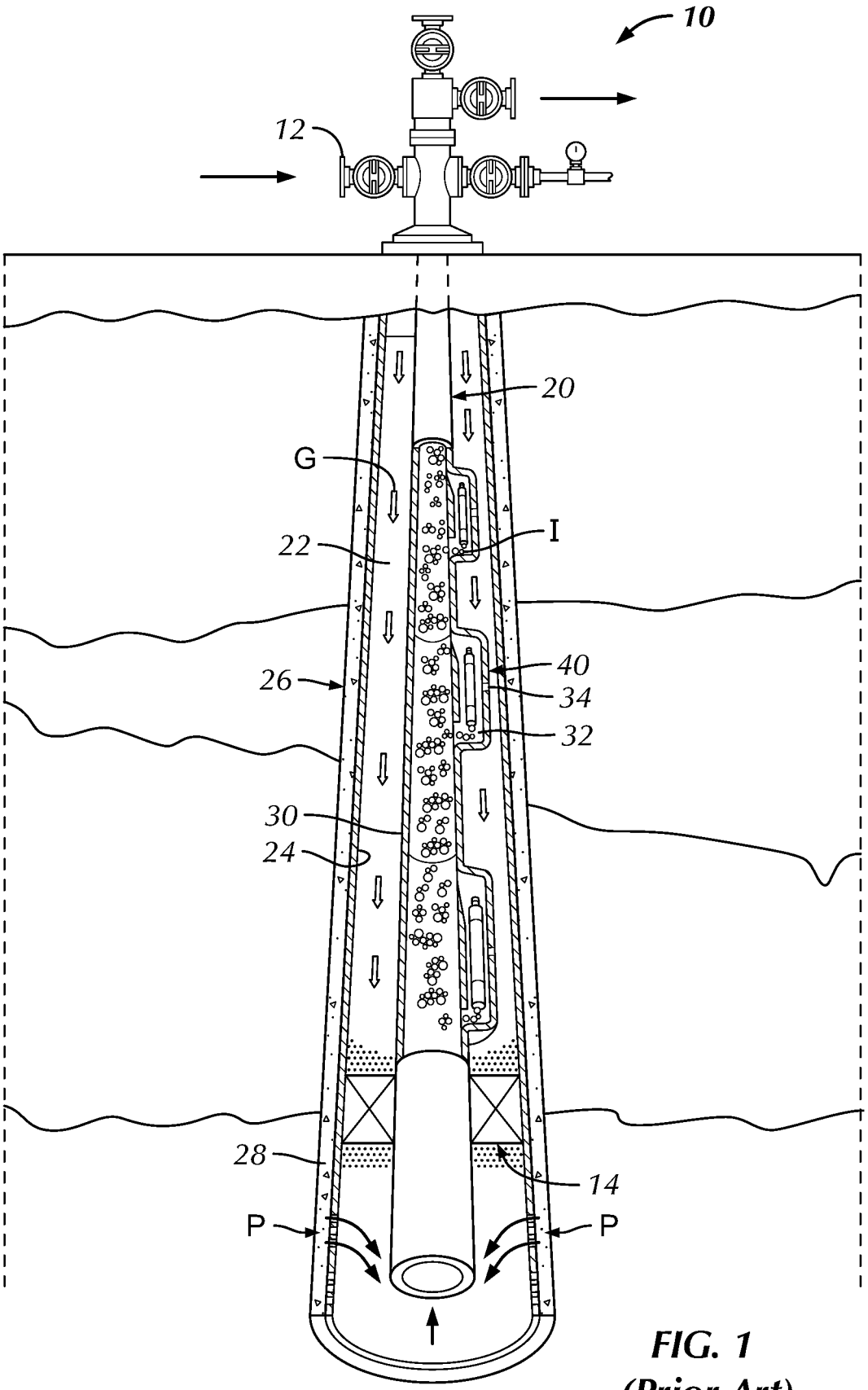
FIG. 1 (Prior Art)
FIG. 1 illustrates a conventional gas lift system.
Figure 2A:
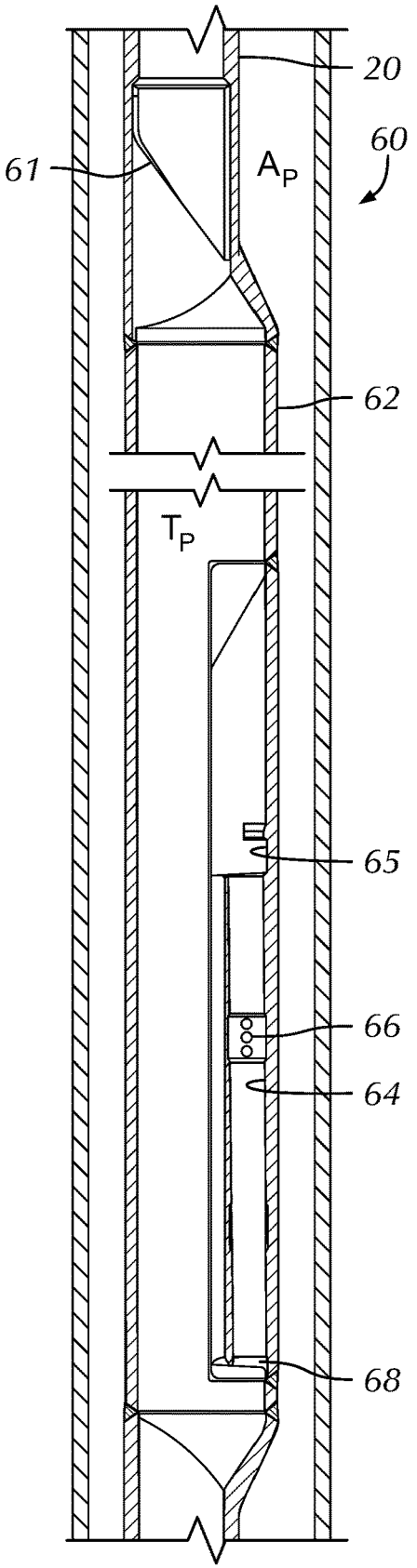
FIGS. 2A-2B illustrate a gas lift mandrel without and with a gas lift valve of the present disclosure installed.
Figure 2B:
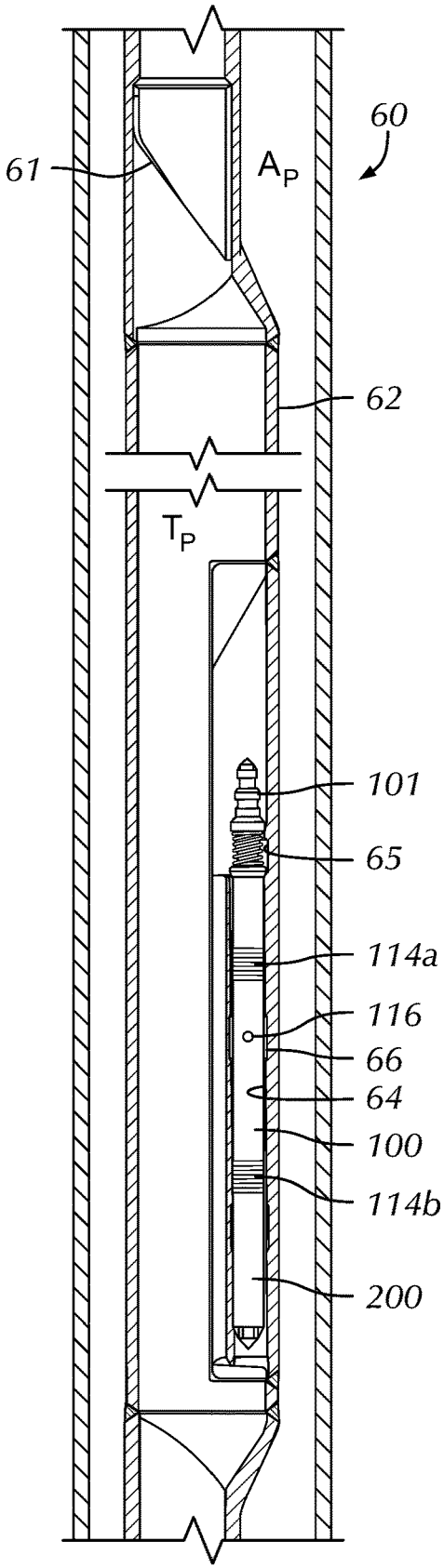

Referring to FIGS. 2A-2B, a gas lift mandrel 60 is installed on a completion string 20 of a wellbore completion. The mandrel 60 is shown without and with a gas lift valve 100 of the present disclosure installed. As shown here, the gas lift valve 100 is wireline-retrievable, but the teachings of the present disclosure can apply to other types of valves, such as tubing-retrievable valves when used with an appropriate mandrel and tubing running procedures. The gas lift valve 100 includes an activation assembly 200 according to the present disclosure. The activation assembly 200 is initially in a closed condition, but is configured to open once activated, as discussed later.

While the activation assembly 200 is in the closed condition, the valve 100 can be run into the tubing sting 20 by wireline and can be inserted into the side pocket 64 of the mandrel 60. A latch 101 of the valve 100 engages a profile 65 in the side pocket 64 to hold the valve 100 therein. Packing seals 114*a-b* on the valve 100 isolate fluid communication between a port 66 on the mandrel 60 and a valve port 116 on the valve 100.

The valve 100 with the activation assembly 200 can be an unloading-type of gas lift valve used for a typical tubing flow application. In this instance as will be described throughout the present disclosure, gas is injected down the annulus 22 in order to enter the tubing 20 through the mandrel 60 and the gas lift valve 100 so the injected gas can then lift production fluid up the tubing 20. As an alternative, the valve 100 with the activation assembly 200 can be used in annular flow configuration in which gas is instead injected down the tubing 20 in order to enter the annulus 22 through the gas lift valve 100 and the mandrel 60 so the injected gas can then lift production fluid up the annulus 22. Although the annular flow configuration is less common, it is applied in certain circumstances. To achieve the annular flow configuration, features and operation of the disclosed valve 100 and the activation assembly 200 are essentially reversed, and a different form of gas lift mandrel may be used. In general, the inlet of the gas lift valve 100 is exposed to the tubing 20 instead of the annulus 22, while the outlet of the gas lift valve 100 is exposed to the annulus 22 instead of the tubing 20. The activation assembly 200 operates with the pressure differential between the inlet and outlet to configure the active opening of the valve 100.

Instead of being conventional, the gas lift valve 100 is configured to remain closed during installation and during initial testing of the completion. Therefore, once the valve 100 is installed, the activation assembly 200 keeps the valve 100 closed so pressure testing can be performed. For example, the tubing pressure $T_P$ can be increased in the tubing string 20 to test the tubing's integrity, and the annulus pressure $T_P$ can be increased to test the casing's integrity.

After testing is completed, the valve 100 can be opened when ready to inject gas through the side pocket mandrel 60 and the valve 100 for entry into the tubing 20 of the completion string. In particular, the gas lift valve 100 is configured to open at a predetermined pressure so the valve 100 can be used for gas injection. In this way, wireline intervention to remove a dummy valve and replace it with a live gas lift valve is not needed to test the completion's integrity as required in conventional practice. To achieve the configured opening of the valve 100, the valve 100 includes the activation assembly 200 to control the initial activation of the gas lift valve 100. Details of the activation assembly 200 are discussed later.

Figure 2C:
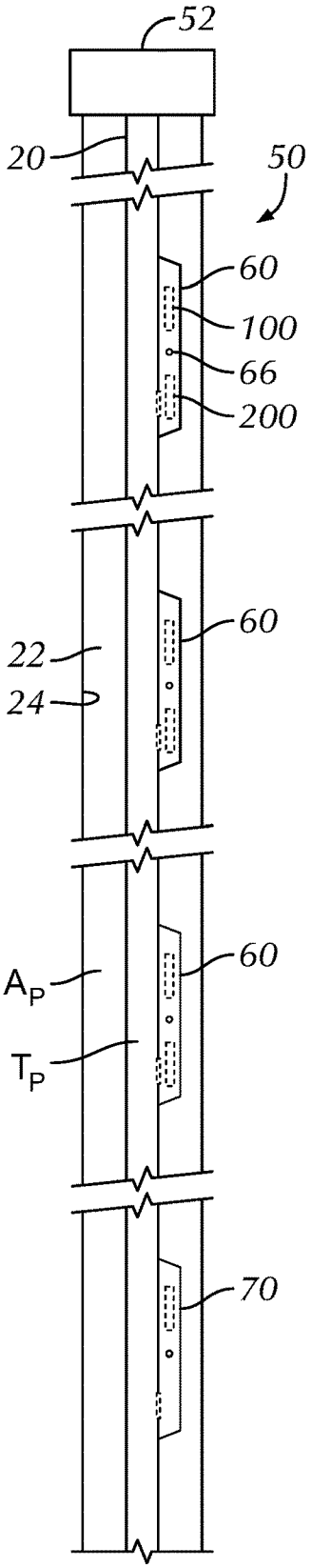
FIG. 2C illustrates a completion having gas lift valves according to the present disclosure.

An example completion assembly 50 is shown in FIG. 2C having multiple gas lift valves 100 installed on a completion string 20 disposed in casing 24 of a wellbore. Each of the gas lift valves 100 is installed in a gas lift mandrel 60 on the completion string 20, and each of the valves 100 has an activation assembly 200 to control the initial activation of the gas lift valve 100.

The multiple gas lift valves 100 can be used together with a shear orifice valve 70 installed at the deepest point in the completion assembly 50. The shearable orifice valve 70 has a shear open mechanism set to open at a higher pressure than the activation pressure for the activation assembly 200 on the gas lift valves 100. An example of such a shearable orifice valve 70 is the "RDDK-2A Shearable Orifice Gas-Lift Valve" available from Weatherford International, Inc.

The activation assemblies 200 allow the casing 24, tubing string 20, and other components (e.g., packers) in the well completion 50 to be tested. Then, once activated open, the open assemblies 200 allows gas lift operations to proceed without wireline intervention. Different configurations can be used for the activation.

In one configuration, the activation assemblies 200 of the valves 100 are configured to open after testing in response to increased annulus pressure $A_P$ in the annulus 22. As used herein, "annulus pressure" $A_P$ refers to the pressure in the annulus 22 between the tubing 20 and the wellbore casing 24. By contrast, "tubing pressure" $T_P$ refers to the pressure in the tubing of the completion string 20 in the wellbore.

During testing in this configuration, for example, the tubing 20 and the annulus 22 are filled with completion fluid, which creates hydro-static pressure on each inlet and outlet side of the valves 100. Operators first perform a tubing test by increasing the tubing pressure $T_P$ to a set test pressure. This tests the integrity of the tubing of the completion string 20. The operators then bleed off the tubing pressure $T_P$.

At this point, operators increase the annulus pressure $A_P$ to apply a set test pressure to the annulus 22 from the surface. This increase in annulus pressure $A_P$ tests packers (not shown) and the casing 24 of the completion 50 by creating a pressure differential between the casing 24 and the tubing 20.

With the casing's integrity tested, the annulus pressure $A_P$ is then increased to a first predetermined level above the set test pressure to open the activation assemblies 200 of the gas lift valves 100. The annulus pressure $A_P$ is then increased even further to a second, higher predetermined level to open the shearable orifice valve 70.

Once the annulus pressure $A_P$ reaches the opening pressure differential of the shearable orifice valve 70, the annulus and tubing pressures $A_P$, $T_P$ throughout the wellbore will equalize. With the pressures $A_P$, $T_P$ then equalized, the gas lift valves 100 are now in open conditions and ready for gas injection operations.

In another configuration, the activation assemblies 200 of the gas lift valves 100 are configured to open after testing in response to increased tubing pressure $T_P$. (This installation may not use the shearable orifice valve 70 on the completion 50.) During testing, for example, the tubing 20 and the annulus 22 are filled with completion fluid, which creates hydro-static pressure on each side of the valves 100. Operators first perform a casing integrity test by increasing the annulus pressure $A_P$ from the surface to a set test pressure. This increase in annulus pressure $A_P$ tests any packers and tests the casing 24 of the completion 50 by creating a pressure differential in the annulus 22 relative to the tubing 20. The annulus pressure $A_P$ is then bled off.

Operators then increase the tubing pressure $T_P$ to a predetermined level that opens the activation assemblies 200 of the gas lift valves 100. Although the valves 100 are now open, certain check valves (e.g., check valve 160 in FIGS. 3 and 4A-4B) in the gas lift valves 100 will close and prevent reverse flow of pressure from the tubing 20 to the annulus 22. The operators now test the tubing integrity by increasing the tubing pressure $T_P$ to a set test level. The tubing pressure $T_P$ is then bled off, and the gas lift valves' activation devices 200 are now in opened conditions and ready for gas injection.

Having an understanding of how an activation assembly 200 of the present disclosure is used on a gas lift valve 100 in a completion assembly 50, discussion now turns to particular details of the different configurations of the activation assembly 200.

Figure 3:
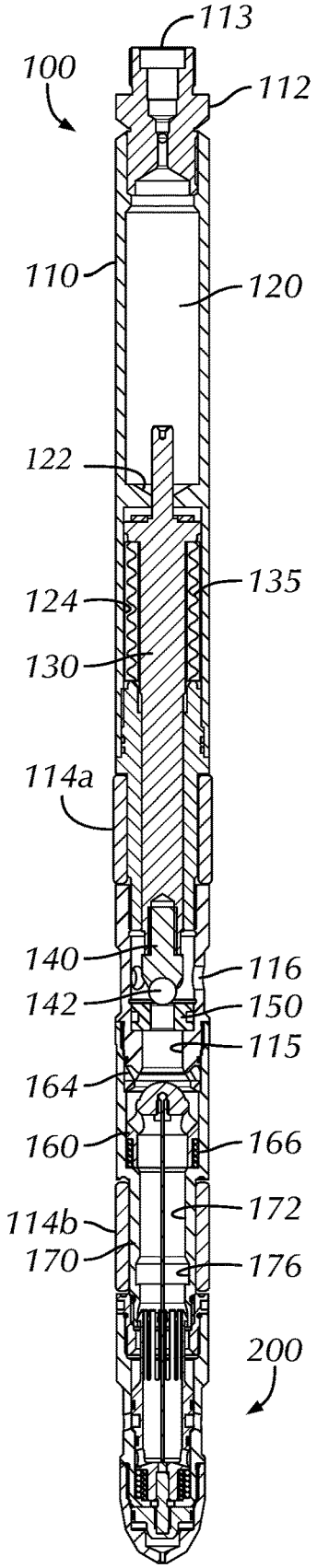
FIG. 3 illustrates a gas lift valve having a first activation assembly according to the present disclosure.

Referring to FIG. 3, a gas lift valve 100 having an activation assembly 200 according to a first configuration is shown in cross-section. As shown, the valve 100 is an unloading-type of gas lift valve, and the activation assembly 200 is configured to open the valve 100 in response to an increased annulus pressure (i.e., the pressure that can enter the valve 100 through its injection ports 116).

The valve 100 includes a housing 110 having packing stacks 114*a-b* disposed thereabout and having the activation assembly 200 disposed toward the valve's outlet side. The packing stacks 114*a-b* provide a seal that isolates the annulus and tubing pressures when installed in a typical side-pocket gas lift mandrel, such as the mandrel 60 of FIGS. 2A-2C. In this way, the valve 100 of FIG. 3 run into the mandrel (60) is exposed to annular pressure through the injection ports 116. Thus, when the term "annular pressure" is used in reference to the valve 100, it means the pressure communicated inside the valve 100. Reference to tubing pressure, however, refers to the pressure in the completion string to which the outlet of the valve 100 is exposed.

Internally, the valve 100 uses a pressure-sensitive valve mechanism to control gas injection. In particular, the valve 100 has a dome chamber 120 and a bellows 135 that bias a valve piston 130 in the valve 100 to control the flow of injected gas entering from the valve port 116 to an injection passage 115 inside the valve 100. The dome chamber 120 holds a compressed gas, typically nitrogen, which is filled through a port 113 in a top member 112. This port 113 typically has a core valve (not shown) for filing the chamber 120 and typically has an additional tail plug (not shown) installed during assembly. (Various other components of the valve 100, such as a latch connected to the top end, are not shown, but would be present, as one skilled in the art would be appreciated.)

The bellows 135 is disposed on the valve piston 130 in an ancillary chamber 124 separated from the dome chamber 120 by a chamber seat 122. The bellows 135 separates the compressed gas in the dome chamber 120 from communicating with the valve port 116 and the injection passage 115 so pressure can be maintained in the chamber 120. Accordingly, the valve 100 uses this bellows 135 as the membrane between the dome chamber 120 and the annulus injection pressure that opens the valve 100.

Looking at the valve piston 130 in more detail, the valve piston 130 can move between opened and closed conditions in the valve 100. Opposite the bellows 135, the valve piston 130 has a distal end 140 that moves relative to an inner seat 150 of the housing 110. The piston's distal end 140 has a valve head 142, which can be spherical in shape to engage the seat 150. In controlling the flow of injected gas, the valve head 142 on the piston's distal end 140 engages or disengages the seat 150 to close and open communication from the valve port 116 to the injection passage 115.

To prevent reverse flow from the tubing to the annulus through the valve 100, a check valve 160 is used at the injection passage 115 of the valve 100. As is typical, the check valve 160 can be a dart valve with ports 162. A spring 166 biases the check valve 160 toward a seat 164, which may have an elastomeric component and a retainer, although other types of seals could be used.

Rather than having a conventional outlet for passage of injected gas directly out of the valve 100 from the injection passage 115 to a completion string (not shown), the valve 100 of FIG. 3 includes the activation assembly 200 installed on the outlet end of the valve 100 for controlling initial fluid communication from the inject passage 115 out of the valve 100. The activation assembly 200 modifies the initial operation of the valve 100 in a manner described latter.

In general, the activation assembly 200 can be attached/threaded to the end of the gas lift valve 100 in place of a conventional nose. As will be appreciated, the activation assembly 200 can be adapted to fit to standard gas lift valves and to be used in standard gas lift mandrels. For example, the activation assembly 200 can be a module threaded onto a packing housing component 170 of the gas lift valve 100. As discussed in more detail later, the activation assembly 200 is configured to remain initially closed for completion integrity testing and is configured to open at a predetermined pressure after the integrity tests have been completed so the valve 100 can be opened for gas injection.

In regular operation, however, injected gas passing into the valve 100 through the injection ports 116 above an injection pressure can overcome the bias of the valve piston 130. The injected gas can pass into the injection passage 115 when the valve head 142 is distanced opened from the seat 150. The injected gas can then overcome the bias of the reverse check valve 160 and can exit injection ports 204 to enter the completion tubing for the gas lift operation.

Before such regular operation can be performed, however, the activation assembly 200 that modifies the initial operation of the valve 100 must first be opened. Detailed views of the activation assembly 200 are shown in a closed condition of FIG. 4A and in an opened condition of FIG. 4B. (The piston's stem end 140 is not depicted with any particular operational position in FIGS. 4A-4B and is merely depicted in a given position for illustrative purposes. As will be appreciated, the piston's stem end 140 will move opened and closed depending on the piston's exposure to annular pressure relative to the dome pressure in the piston's chamber.)

The activation assembly 200 includes a piston housing 202 affixed to the packing housing 170 of the valve 100. In fact, the piston housing 202 may retain the lower packing stack 114*b* on the packing housing 170. The piston housing 202 has outlet ports 204 communicating the interior of the housing 202 out of the assembly 200 for injection of gas from the valve 100 to the completion string. The piston housing 202 also has a nose 206 affixed on its end having a tubing pressure port 208.

Figure 4A:
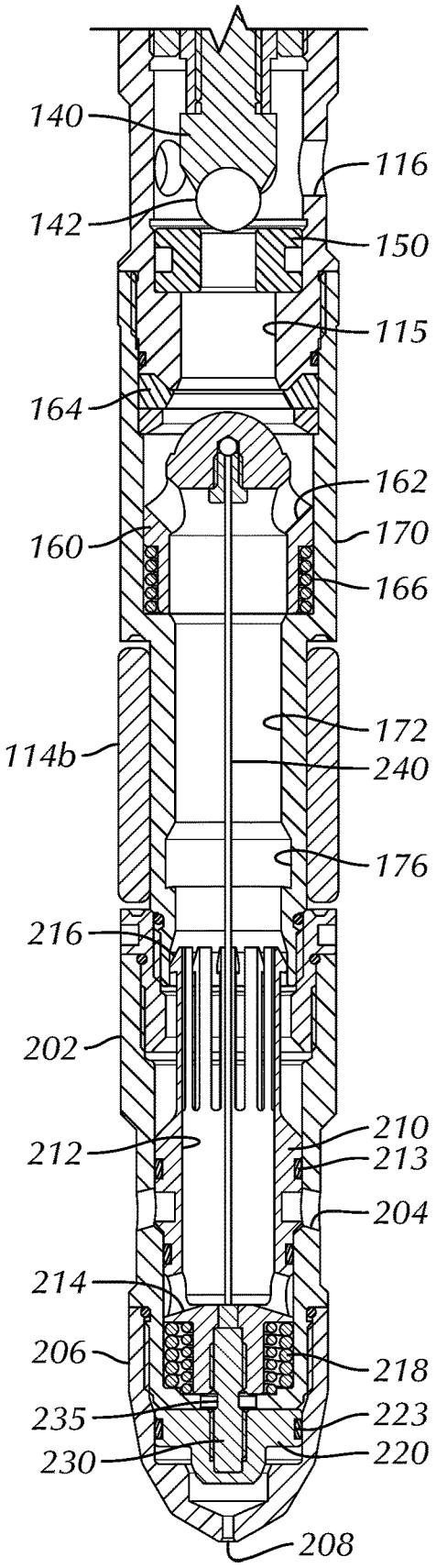
FIGS. 4A-4B illustrate details of the first activation assembly during stages of operation.
Figure 4B:
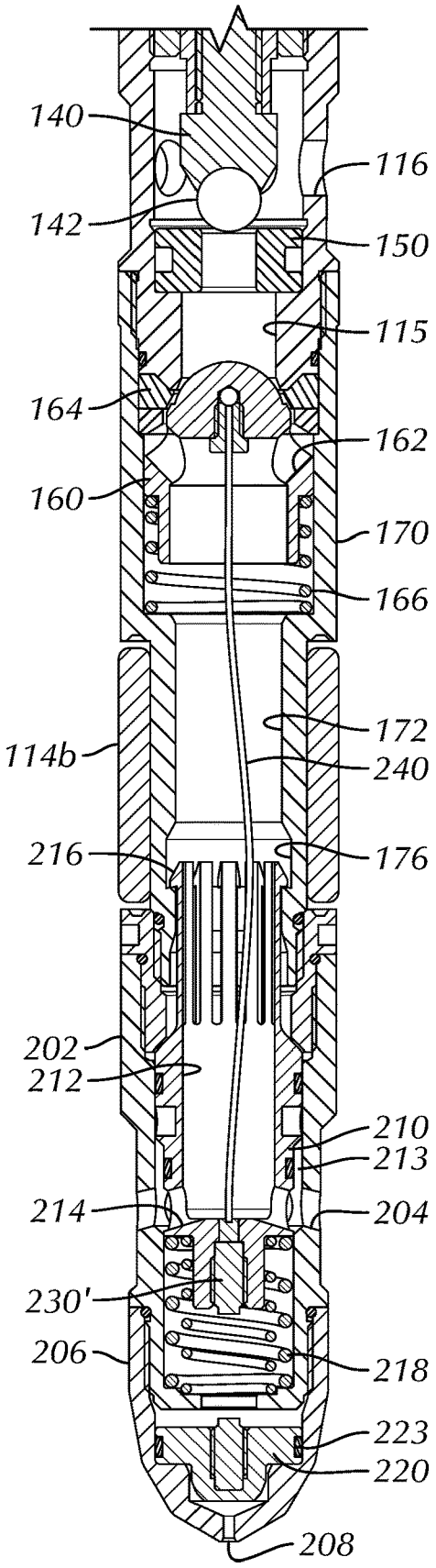

Internally, the housing 202 contains a piston sleeve or sleeve body 210 movable in the housing 202 from a closed condition (with openings 214 unaligned with the outlet ports 204 as shown in FIG. 4A) to an opened condition (with openings 214 aligned with the outlet ports 204 as shown in FIG. 4B). The piston sleeve 210 includes seals 213 sealing off the outlet ports 204 when the sleeve 210 is in the closed condition of FIG. 4A. The piston sleeve 210 also includes a collet 216 or other form of lock for engaging a lock profile either in the piston housing 202 or elsewhere, such as in a lock profile 176 in the packing housing 170 as shown in FIGS. 4A-4B.

A spring 218 biases the piston sleeve 210 from the closed condition (FIG. 4A) to the opened condition (FIG. 4B), but a temporary connection 230 affixed to an activation piston or piston body 230 in the assembly 200 prevents the biased movement of the piston sleeve 210. (The temporary connection 230 is shown here as a fracture or shear rod. As will be appreciated, the temporary connection 230 can use other shearable or breakable connections.)

As shown, the piston sleeve 210 sealed in the housing 202 with the seals 213 is exposed to a pressure differential between annulus pressure (via piston housing 202) and tubing pressure (via outlet ports 204). As also shown, the activation piston 220 sealed in the nose 206 with seals 223 is exposed to a pressure differential between annulus pressure (via piston housing 202) and tubing pressure (via tubing pressure port 208). The fracture rod 230 has a division or breakable portion 235 configured to break/fracture under a predetermined load caused by the pressure differential (and the added bias of the spring 218).

Once the valve 100 is installed and before regular operation can commence, pressure integrity tests can be performed as described above. With the assembly 200 in its initial condition as in FIG. 4A, for example, the tubing integrity is tested first. Pressure in the tubing of the completion is increased to a predetermined test pressure while the piston sleeve 210 remains held in its closed condition. The differential pressure between the tubing and annulus pressures ($A_P$, $T_P$) act on the effective area between the lower and upper seals 213 (e.g., O-rings) on the piston sleeve 210. The differential pressure also acts on the activation piston 220, but the assembly 200 does not shear open during this phase of testing. After the tubing test is done, the assembly 200 remains in the closed position.

The next step is to pressure test the casing annulus to a first predetermined pressure. This allows the differential between the annulus and tubing pressures ($A_P$, $T_P$) to act on the full area of the lower piston 220. Once the casing is tested to the predetermined pressure, the assembly 200 is activated by increasing the pressure in the valve 100, which is the annulus pressure of the completion. At the surface, for example, an operator increases the pressure in the annulus around the completion string, but not within the completion string. The annulus pressure ($A_P$) is increased to a predetermined breaking pressure of the fracture rod 230.

In particular, the increasing annulus pressure $A_P$ can pass through the injection ports 116, through the open piston 130, past the open check valve 160, and into the activation assembly 200. Meanwhile, the sleeve 210 in the assembly's piston housing 202 is held closed by the fracture rod 230 coupled to the activation piston 220. For its part, the activation piston 220 is exposed on its uphole-side to the increasing annulus pressure ($A_P$) inside the piston housing 202 and is exposed on its downhole-side via the tubing port 208 to the lower tubing pressure ($T_P$) present in the completion string.

By increasing the annular pressure ($A_P$) relative to the tubing pressure ($T_P$), the activation piston 220 is pushed downward with respect to the other parts of the valve 100. When the force pushing on the piston 220 is great enough, the fracture rod 230 is stretched to failure at its breaking point 235, causing failure of the fracture rod 230. When the casing pressure is bled off, the spring 218 inside the piston housing 202 is then able to push the inner sleeve 210 so that the openings 214 in the sleeve 210 align with the ports 204 in the piston housing 210. At this point, the valve 100 is in fluid communication, though the side pocket mandrel, with the inside of the completion string.

As the wellbore equalizes, however, a string or wire 240 connected to the piston sleeve 210 and the check valve 160 holds the check valve 160 momentarily in the open position, allowing the annulus pressure ($A_P$) to evacuate the area between the check valve 160 and the lower piston sleeve 210. This function is desired because pressure trapped in the area between the check valve 160 and the piston housing 170 may act on the larger net force of the piston sealing area and prevent the piston sleeve 210 from shifting to the open position.

Once the wellbore equalizes, the spring 218 forces the piston sleeve 210 to the opened condition as shown in FIG. 4B, allowing the collets 216 to lock into the mating shoulder 176 in the packing housing 170. After the piston sleeve 210 is shifted, the slack in the wire 240 allows the check valve 160 to then function normally as a spring-loaded, one-way valve.

With the piston sleeve 210 in the locked and opened condition as shown in FIG. 4B, the flow passages 214, 204 are aligned in the piston sleeve 210 and the housing 202 allowing for passage of injected gas. In this way, lift gas can enter the valve 100 from the casing via ports 116 to the tubing via ports 204, thereby allowing the unloading and producing process to begin without wireline intervention.

Although a shear or fracture rod 230 is disclosed, it is possible to use other types of shearable or breakable connections. For example, although the rod 230 is configured to break in response to a longitudinal load, shear pins, screws, or other temporary connections could be used and configured to break due to a lateral or shear load.

The interconnecting wire 240 can be intended to remain inside the valve 100 during operations, as long as the wire 240 does not interfere with the operation of the check valve 160 or the flow of injection gas out of the valve 100. Alternatively, the wire 240 can be composed of a material that is degradable, dissolvable, or disintegrable over time in response to certain environmental conditions. For example, the wire 240 can be composed of a reactive metal alloy, such as an aluminum-based alloy or a magnesium-based alloy, or can be composed of a degradable plastic material, such as polyglycolic acid (PGA), polylactic acid (PLA), or the like.

Although described above as a wire 240 using tension and slack to temporarily hold the check valve 160 open, other forms of connection can connect the piston sleeve 210 to the check valve 160 to hold the check valve 160 open and then release the hold of the check valve 160. For example, the connection 240 can be a stiff rod of a given length holding the check valve 160 open as long as the piston sleeve 210 is closed. Shifting of the piston sleeve 210 open can allow the check valve 160 to open, but the difference in displacement between the two can break the stiff rod 240 in one or more places. The broken rod 240 can remain in the valve 100 or can be composed of a material that is degradable, dissolvable, or disintegrable. These and other forms of connection 240 can be used between the piston sleeve 210 and check valve 160.

Figure 5:
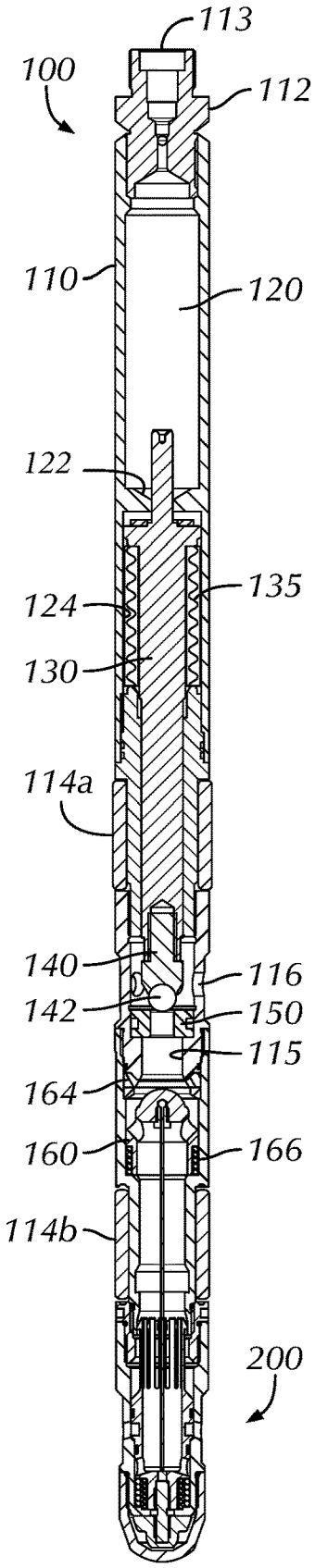
FIG. 5 illustrates a gas lift valve having a second activation assembly according to the present disclosure.

Referring to FIG. 5, a gas lift valve 100 having an activation assembly 200 according to a second configuration is shown in cross-section. The valve 100 is similar to that disclosed above with respect to FIGS. 3 and 4A-4B so that like reference numerals are used for similar components.

As before, the valve 100 in FIG. 5 is an unloading-type of gas lift valve. The valve 100 installs in a typical gas lift mandrel, and the packing stacks 114*a-b* provide a seal that isolates the annulus and tubing pressures. The valve 100 includes a housing 110 having packing stacks 114*a-b* disposed thereabout and having the activation assembly 200 disposed toward the valve's outlet side. The packing stacks 114*a-b* provide a seal that isolates the annulus and tubing pressures when installed in a typical side-pocket gas lift mandrel, such as the mandrel 60 of FIGS. 2A-2C.

The activation assembly 200 is installed on the outlet end of the valve 100 for controlling initial fluid communication from the inject passage 115 out of the valve 100. Rather than being configured to open in response to an increased annulus pressure (La, the pressure that can enter the valve 100 through its injection ports 116), the activation assembly 200 of FIG. 5 is configured to open the valve 100 in response to an increased tubing pressure (i.e., the pressure to which the outlet of the valve 100 is exposed).

Figure 6A:
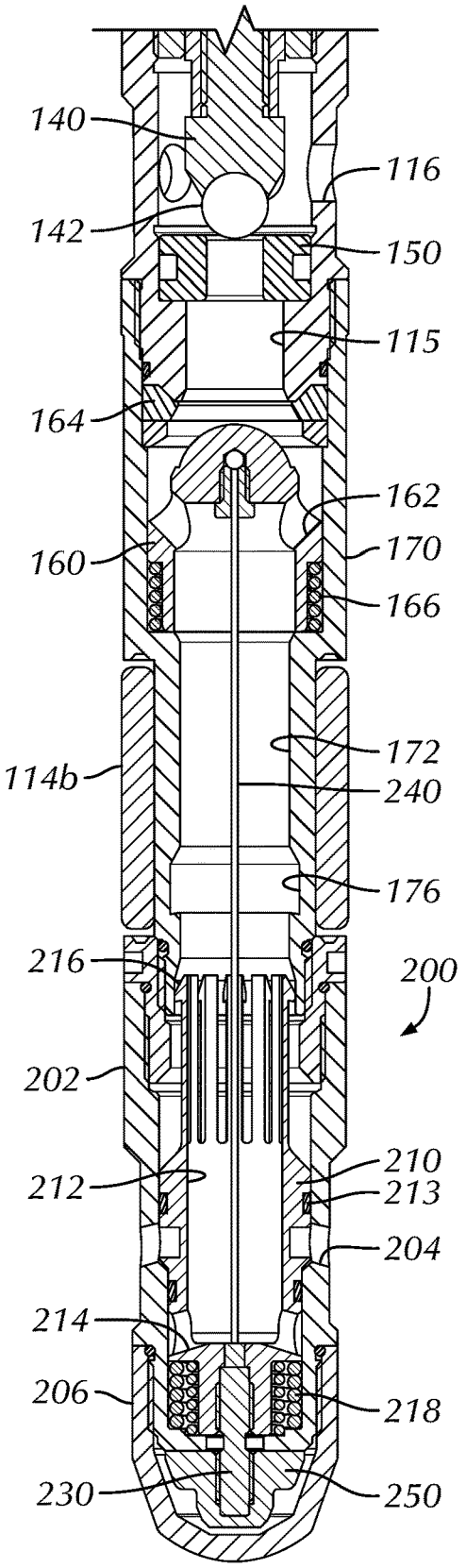
FIGS. 6A-6B illustrate details of the second activation assembly during stages of operation.
Figure 6B:
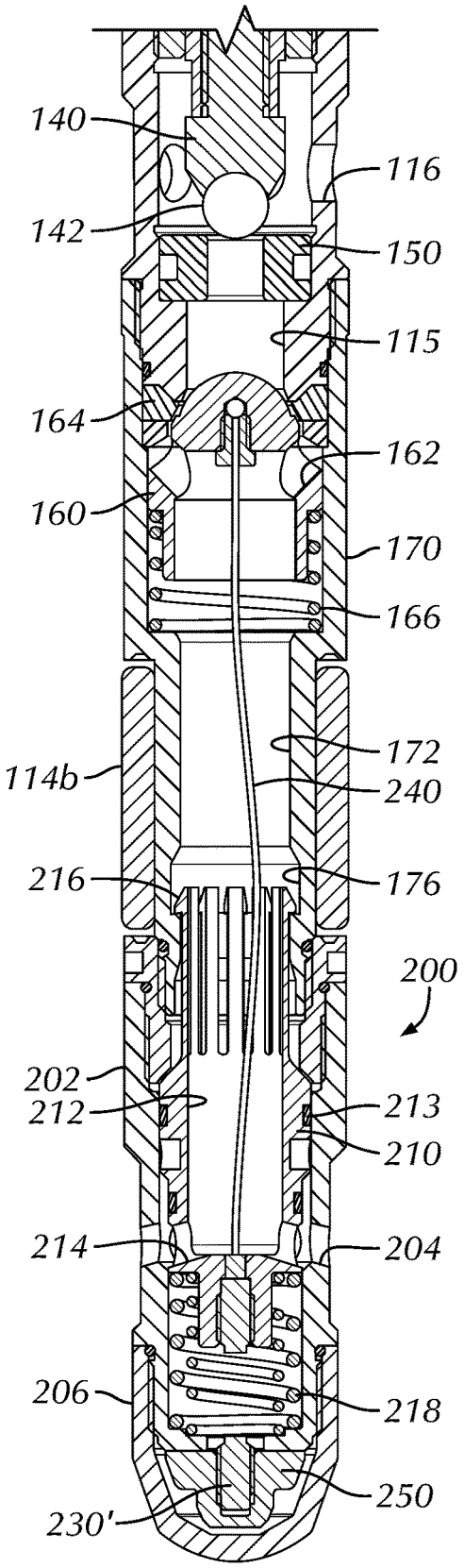

Detailed views of the activation assembly 200 are shown in a closed condition of FIG. 6A and in an opened condition of FIG. 6B. (The piston's stem end 140 is not depicted with any particular operational position in FIGS. 6A-6B and is merely depicted in a given position for illustrative purposes. As will be appreciated, the piston's stem end 140 will move opened and closed depending on the piston's exposure to pressure relative to the dome pressure in the piston's chamber.)

The activation assembly 200 includes a piston housing 202 affixed to the packing housing 170 of the valve 100. The piston housing 202 has outlet ports 204 communicating the interior of the housing 202 out of the assembly 200 for injection of gas from the valve to the tubing of a completion. The piston housing 202 also has a closed nose 206 affixed on its end.

Internally, the housing 202 contains a piston sleeve or sleeve body 210 movable in the housing 202 from a closed condition (with openings 214 unaligned with the outlet ports 204 as shown in FIG. 6A) to an opened condition (with openings 214 aligned with the outlet ports 204 as shown in FIG. 6B). The piston sleeve 210 includes seals 213 sealing off the outlet ports 204 when the sleeve 210 is in the closed position of FIG. 6A. The piston sleeve 210 also includes a collet 216 or other form of lock for engaging a lock profile either in the piston housing 202 or elsewhere, such as in the lock profile 176 in the packing housing 170 as shown in FIGS. 6A-6B.

A spring 218 biases the piston sleeve 210 from the closed condition (FIG. 6A) to the opened condition (FIG. 6B), but a temporary connection 230 (e.g., a fracture rod) affixed to the housing 202 via an anchor 250 prevents the biased movement of the piston sleeve 210. As shown, the piston sleeve 210 sealed in the housing 202 with seals 213 is exposed to a pressure differential between annulus pressure (via piston housing 202) and tubing pressure (via out ports 204). The fracture rod 230 has a division or breakable portion 235 configured to break/fracture under a predetermined load caused by the pressure differential (and the added bias of the spring 218).

Once the valve 100 is installed and before regular operation can commence, pressure integrity tests can be performed as described above. With the assembly 200 in its initial condition as in FIG. 6A, for example, the casing integrity is tested first. Pressure is applied to the casing annulus of the well for testing. The force from the annulus pressure ($A_P$) acts on the piston sleeve 210, which will hold the piston sleeve 210 in the closed position of FIG. 6A.

Once the annulus pressure test is completed, the annulus pressure ($A_P$) is released. As the annulus pressure ($A_P$) is released, the connected string or wire 240 holds the spring loaded check valve 160 in the open position, thereby allowing the pressure between the check valve 160 and the nose 206 of the assembly 200 to be evacuated. This function is desired because pressure trapped in the area between the check valve 160 and the nose 206 may act on the larger net force of the piston sealing area (upper and lower seals 213) and prevent the piston sleeve 210 from opening during the tubing shear operation discussed below.

After the casing pressure test, the next step is to test the tubing integrity. The tubing pressure ($T_P$) is increased to a test level to test the integrity of the tubing of the completion. The fracture rod 230 can be configured to break at a pressure differential higher or lower than the planned tubing test. Either way, the increased tubing pressure can reach the breaking pressure of the fracture rod 230.

In a completion of multiple gas lift valves, all the activation assemblies 200 can designed to open at relatively the same differential pressure. However, as each fracture rod 230 breaks, the piston sleeve 210 travels in the upward position. As this occurs, the tension of the connecting wire 240 is released and allows the check valve 160 to travel to the closed position. Because the check valves 160 shift to the closed position after each individual assembly 200 shears, the tubing pressure can be increased at some value above the designed shear value. This can help insure all the assemblies 200 of the multiple gas lift valves 100 are shifted in the open position.

After the tubing shear operation is complete, the piston sleeve 210 shifts in the upward position allowing the piston ports 214 to be aligned with the outlet ports 204 on the housing 202 and thereby allow for passage of injected gas. The piston sleeve 210 is held in the open condition by collets 216 that interlock in the mating shoulder 176 in the packing housing 170.

After the piston sleeve 210 is shifted, the slack in the wire 240 allows the check valve 160 to function normally as a spring-loaded one-way valve. Accordingly, the check valve 160 can prevent the increased tubing pressure $T_P$ from communicating out of the gas lift valve 100 so further testing of the tubing integrity can be performed. After the above operations, the gas lift valve 100 is ready for regular operation in which lift gas can enter the valve 100 from casing to tubing via port 116 to the tubing via ports 204, thereby allowing the unloading and producing process to begin without wireline intervention.

Although a shear or fracture rod 230 is disclosed, it is possible to use other types of shearable or breakable connections. For example, although the rod 230 is configured to break in response to a longitudinal load, shear pins, screws, or other temporary connections could be used and configured to break due to a lateral or shear load.

Again, the interconnecting wire 240 can be intended to remain inside the valve 100 during operations, or it can be composed of a material that is degradable, dissolvable, or disintegrable over time in response to certain environmental conditions. Moreover, other forms of connection 240 can connect the piston sleeve 210 to the check valve 160 to hold the check valve 160 open and then release the hold of the check valve 160.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. An apparatus for a gas lift valve on tubing in a wellbore, the gas lift valve having a pressure-sensitive valve and a check valve, the pressure-sensitive valve configured to control communication from an inlet toward an outlet, the inlet exposed to one of annulus pressure of the wellbore and tubing pressure of the tubing, the outlet exposed to the other of the annulus pressure and the tubing pressure, the check valve configured to prevent communication from the outlet toward the inlet, the apparatus comprising:

a piston disposed between the check valve and the outlet and exposed to a pressure differential between the annulus pressure and the tubing pressure, the piston movable from a closed condition to an opened condition relative to the outlet;

a first connection holding the piston in the closed condition and configured to release hold of the piston in response to a predetermined level of the pressure differential; and a second connection connecting the piston to the check valve, the second connection with the piston in the first position holding the check valve open, the second connection with the piston in the second position releasing the hold of the check valve to close.

2. The apparatus of claim 1, wherein the piston comprises:

a piston body sealed in the valve, the piston body exposed to the pressure differential between the annulus pressure in the valve and the tubing pressure via a tubing port of the valve; and a sleeve body sealed in the valve and movable from the closed condition to the opened condition relative to the outlet port, wherein the first connection connects the piston body to the sleeve body, and wherein the second connection connects the sleeve body to the check valve.

3. The apparatus of claim 2, wherein the first connection comprises a rod having a first end coupled to the piston body and having a second end coupled to the sleeve body, the rod breakable in response to a predetermined load between the first and second ends caused by the annulus pressure greater than the tubing pressure.

4. The apparatus of claim 2, wherein the second connection comprises a wire having a first end affixed to the check valve and a second end affixed to the sleeve body, the sleeve body in the closed condition holding the check valve open with tension of the wire, the sleeve body in the opened condition releasing the tension of the wire on the check valve to close.

5. The apparatus of claim 1, wherein the piston comprises:

a sleeve body sealed in the valve and exposed to the pressure differential, the sleeve body movable from the closed condition to the opened condition relative to the outlet; and wherein the first connection connects the sleeve body to a fixed portion of the valve, and wherein the second connection connects the sleeve body to the check valve.

6. The apparatus of claim 5, wherein the first connection comprises a rod having a first end coupled to the sleeve body and having a second end coupled to the fixed portion of the valve, the rod breakable in response to a predetermined load between the first and second ends caused by the tubing pressure greater than the annulus pressure.

7. The apparatus of claim 5, wherein the second connection comprises a wire having a first end affixed to the check valve and a second end affixed to the sleeve body, the sleeve body in the closed condition holding the check valve open with tension of the wire, the sleeve body in the opened condition releasing the tension of the wire on the check valve to close.

8. The apparatus of claim 1, wherein the first connection comprises a rod having a first end coupled to the piston and having a second end coupled separately, the rod breakable in response to a predetermined load between the first and second ends caused by the pressure differential.

9. The apparatus of claim 1, wherein the second connection comprises a wire having a first end affixed to the check valve and a second end affixed to the piston, the piston in the closed condition holding the check valve open with tension of the wire, the piston in the opened condition releasing the tension of the wire on the check valve to close.

10. The apparatus of claim 1, wherein the piston comprises a lock locking the piston in the opened condition once moved.

11. The apparatus of claim 10, wherein the lock comprises a collet disposed on the piston engageable with a shoulder defined in the valve.

12. The apparatus of claim 1, wherein the piston comprises seals sealing off the outlet with the piston in the closed condition.

13. The apparatus of claim 1, wherein the piston comprises an aperture communicating an interior of the piston outside the piston, the aperture misaligned from the outlet with the piston in the closed condition, the aperture aligned with the outlet with the piston in the opened condition.

14. The apparatus of claim 1, wherein the piston comprises a biasing element biasing the piston from the closed condition toward the opened condition.

15. The apparatus of claim 1, further comprising a housing having the piston, the first connection, and the second connection, the housing being integral to the gas lift valve or being separately affixable to the gas lift valve.

16. An apparatus on tubing in a wellbore, the apparatus comprising:

a gas lift valve disposed on the tubing and having an inlet and an outlet, the inlet exposed to one of annulus pressure of the wellbore and tubing pressure of the tubing, the outlet exposed to the other of the annulus pressure and the tubing pressure;

a pressure-sensitive valve disposed in the gas lift valve and configured to control communication from the inlet toward the outlet;

a check valve disposed in the gas lift valve and configured to prevent communication from the outlet toward the inlet;

a piston disposed in the gas lift valve between the check valve and the outlet and exposed to a pressure differential between the annulus pressure and the tubing pressure, the piston movable from a closed condition to an opened condition relative to the outlet port;

a first connection holding the piston in the closed condition and configured to release hold of the piston in response to a first predetermined level of the pressure differential; and a second connection connecting the piston to the check valve, the second connection with the piston in the first position holding the check valve open, the second connection with the piston in the second position releasing the hold of the check valve to close.

17. The apparatus of claim 16, wherein the check valve comprises a dart body biased with a biasing element toward a seat in the gas lift valve.

18. The apparatus of claim 17, wherein the first connection is configured to release the hold of the piston in response to the first predetermined level of the annulus pressure greater than the tubing pressure, or wherein the first connection is configured to release the hold of the piston in response to the first predetermined level of the tubing pressure greater than the annulus pressure.

19. The apparatus of claim 17, further comprising:

a plurality of the gas lift valve disposed on the tubing; and a shearable orifice disposed on the tubing downhole of the gas lift valves, the shearable orifice being configured to open in response to a second predetermined level greater than the first predetermined level.

20. A method for gas lift in a completion string disposed in a wellbore, the method comprising:

configuring a gas lift valve having an inlet and an outlet by holding a piston in the gas lift valve with a first hold in a first closed condition relative to the outlet and holding a check valve in the gas lift valve with a second hold in a second opened condition between the inlet and the outlet;

installing the gas lift valve on the completion string disposed in the wellbore, whereby the inlet is exposed to one of annulus pressure of the wellbore and tubing pressure of the tubing, whereby the outlet is exposed to the other of the annulus pressure and the tubing pressure;

testing pressure integrity of the completion by alternatingly increasing a pressure differential (i) between the tubing pressure relative to the annulus pressure and (ii) between the annulus pressure relative to the tubing pressure; and actuating the gas lift valve for operation after testing the pressure integrity by:

releasing the first hold on the piston to move from the first closed condition toward a first opened condition relative to the outlet by increasing the pressure differential beyond a predetermined limit of the first hold; and releasing, in response to the movement of the piston, the second hold of the check valve to move from the second opened condition toward a second closed position between the inlet and outlet.

* * * * *